US008104150B1

(12) United States Patent
Catallo

(10) Patent No.: US 8,104,150 B1
(45) Date of Patent: Jan. 31, 2012

(54) APPARATUS INCLUDING AN ASYMMETRICAL WEDGE-LIKE MEMBER FOR CONTROLLING DEFLECTION IN SMALL DIAMETER ROLLS OF AN OPEN WIDTH STABILIZER SO AS TO CREATE A STRAIGHT LINE NIP WITH UNIFORM PRESSURE ACROSS THE NIP

(76) Inventor: Frank Catallo, Old Westbury, NY (US)

( * ) Notice: Subject to any disclaimer, the term of this patent is extended or adjusted under 35 U.S.C. 154(b) by 0 days.

(21) Appl. No.: 12/930,553

(22) Filed: Jan. 11, 2011

Related U.S. Application Data

(60) Provisional application No. 61/401,380, filed on Aug. 12, 2010.

(51) Int. Cl.
*D06C 21/00* (2006.01)

(52) U.S. Cl. ..... 26/18.6

(58) Field of Classification Search ..... 26/18.6, 26/18.5, 99, 51, 51.3; 28/116, 134, 136, 28/138, 139, 165; 162/111, 280, 281
See application file for complete search history.

(56) References Cited

U.S. PATENT DOCUMENTS

| | | | | |
|---|---|---|---|---|
| 2,078,721 | A * | 4/1937 | Scanlon | 26/18.6 |
| 3,015,146 | A * | 1/1962 | Cohn et al. | 26/18.6 |
| 3,973,303 | A * | 8/1976 | Diggle, Jr. | 26/18.6 |
| 4,447,938 | A * | 5/1984 | Catallo | 26/18.6 |
| 5,012,562 | A * | 5/1991 | Catallo | 26/18.6 |
| 5,016,329 | A * | 5/1991 | Milligan et al. | 26/18.6 |
| 5,553,365 | A * | 9/1996 | Catallo | 26/18.6 |
| 5,655,275 | A * | 8/1997 | Allison et al. | 26/18.6 |
| 5,704,102 | A * | 1/1998 | Catallo | 26/18.6 |
| 6,681,461 | B1 * | 1/2004 | Catallo | 26/18.6 |
| 2006/0053603 | A1 * | 3/2006 | Catallo et al. | 26/18.6 |

* cited by examiner

*Primary Examiner* — Amy Vanatta
(74) *Attorney, Agent, or Firm* — Charles E. Baxley

(57) ABSTRACT

An improved apparatus for correcting deflection in small diameter feed and retard rolls of an open width stabilizer so as to create a straight line nip with uniform pressure across the nip. The improved apparatus provides apparatus for adjusting deflection of the rolls to thereby maintain a desired size to a passageway between them so as to optimize compaction of a fabric web material. A wedge-like member is disposed between, and in moving relationship to, feed and retard roller bearings. The wedge-like member is asymmetrical, has feed and retard sides that engage the feed and retard roller bearings, respectively, and exerts reaction forces against each of the respective bearings. Improvement resides in the reaction forces causing the rolls the rolls to not deflect downwardly.

5 Claims, 3 Drawing Sheets

APPARATUS INCLUDING AN ASYMMETRICAL WEDGE-LIKE MEMBER FOR CONTROLLING DEFLECTION IN SMALL DIAMETER ROLLS OF AN OPEN WIDTH STABILIZER SO AS TO CREATE A STRAIGHT LINE NIP WITH UNIFORM PRESSURE ACROSS THE NIP

CROSS REFERENCE TO RELATED APPLICATIONS

The instant non-provisional patent application claims priority from provisional patent application No. 61/401,380, filed on Aug. 12, 2010, entitled WEB NIP WEDGE FACE HAVING ASYMMETRICAL ALIGNMENT TO CONTROL NIP WIDTH FOR COMPRESSIVE PRESHRINKING OF FABRIC, and incorporated herein by reference thereto.

BACKGROUND OF THE INVENTION

A. Field of the Invention

An embodiment of the present invention relates to an apparatus for correcting deflection in an open width stabilizer, and more particularly, an embodiment of the present invention relates to an apparatus for correcting deflection in small diameter rolls of an open width stabilizer so as to create a straight line nip with uniform pressure across the nip.

B. Description of the Prior Art

Circulatory knit fabric produced in the U.S. has mostly been finished in tubular form. Machinery has been developed around an internal spreader to propel the fabric through various finishing operations, such as steaming and compacting, to reduce length shrinkage.

In contrast, Europeans slit the fabric tube, open it, and finish the fabric in open width using mostly woven good finishing equipment, such as tenter frames and belt compactors, some modified to accommodate the elastic nature of the knit construction. To control length shrinkage, the Europeans use various versions of a belt compactor or sanforizing machines, none of which can reduce shrinkage to less than the 5% that is required by most world wide garment manufacturers.

Americans developed a two-roll compactor for tubular fabric, with one roll feeding the fabric at a given speed, and with a second retarding roll slowing the fabric travel to compact the fabric in its length, thus reducing length shrinkage, as required, to a zero length shrinkage on some fabrics.

When the two-roll principal was tried on wide open width circular knits, it became apparent that the rolls would have to be made larger in diameter to reduce deflection, however, this created a wider nip area where the fabric has to change its length dimension, causing objectionable friction on the fabric, resulting in poor quality.

Catallo used a small diameter roll and overcame the deflection problem by bending the rolls to produce a straight nip. A way to do this at the time was by using a wedge between the ends of the rolls, as taught by U.S. Pat. No. 5,553,365 to Catallo. When this system was used in production, however, quality of the fabric was not always acceptable in the full width of the fabric, and it was determined that the nip was not uniform as a result of the wedge's reaction forces to bend the rolls. The rolls were not bent on the nip line, but deflected downward, changing the nip line in the center of the rolls.

The apparatus taught by U.S. Pat. No. 5,553,365 to Catallo can best be seen in FIGS. 1-3, which are, respectively, a diagrammatic perspective view of a prior art two-roll fabric shrinker, an enlarged diagrammatic end view of the area generally enclosed by 1 dotted curve identified by ARROW 2 in FIG. 1, and a diagrammatic top plan view taken generally in the direction of ARROW 3 in FIG. 2, and as such, will be discussed with reference thereto.

As shown in FIG. 1, a prior art shrinker is shown generally at 10 for a fabric web material, and comprises a feed roll 14, a retard roll 16, and an apparatus 18 for adjusting deflection of the feed roll 14 and the retard roll 16 to thereby maintain a desired size to a passageway 20 between the feed roll 14 and the retard roll 16 to optimize compaction of the fabric web material. The feed roll 14 has a pair of ends 22, with only one being shown, and the retard roll 16 has a pair of ends 24, with only one being shown.

The apparatus 18 comprises bearings 26. The bearings 26 of the apparatus 18 are mounted to the pair of ends 22 of the feed roll 14, respectively, with only one being shown. The apparatus 18 further comprises lever bearings 28. The lever bearings 28 of the apparatus 18 are mounted to the pair of ends 24 of the retard roll 16, respectively, with only one being shown. The bearings 26 of the apparatus 18 are in a form of pillow block bearings 29.

The apparatus 18 further comprises a pneumatic cylinder 30, and a shaft 32 having an upper end 34 and a lower end 36. The upper end 34 of the shaft 32 of the apparatus 18 is connected to the lever bearings 28 of the apparatus 18, and the lower end 36 of the shaft 32 of the apparatus 18 is connected to the pneumatic cylinder 30 of the apparatus 18.

By providing for the pivoting of the lever bearings 28 of the apparatus 18 by moving the shaft 32 of the apparatus 18, the feed roll 14 and the retard roll 16 are allowed to move towards or away from one another, thereby changing the desired size of the passageway 20, The apparatus 18 further comprises the feed roll 14 having an axial shaft 38, the retard roll 16 having an axial shaft 40, a feed roller bearing 42, a retard roller bearing 44, and a symmetrical wedge-like member 46.

The feed roller bearing 42 of the apparatus 18 is connected to the axial shaft 38 of the feed roll 14 of the apparatus 18, and the retard roller bearing 44 is connected to the axial shaft 40 of the retard roll 16 of the apparatus 18. The symmetrical wedge-like member 46 of the apparatus 18 is disposed between, and in moving relationship to, the feed roller bearing 42 of the apparatus 18 and the retard roller bearing 44 of the apparatus 18.

As shown in FIG. 2, the symmetrical wedge-like member 46 of the apparatus 18 is a relatively thin solid in front view, and defined by a bottom 52, a top 54, a feed side 56, and a retard side 58. The bottom 52 of the symmetrical wedge-like member 46 of the apparatus 18 is straight and horizontally oriented. The top 54 of the symmetrical wedge-like member 46 of the apparatus 18 is straight, horizontally oriented, and above, parallel to, shorter than, and centered on, the bottom 52 of the symmetrical wedge-like member 46 of the apparatus 18. The feed side 56 of the symmetrical wedge-like member 46 of the apparatus 18 engages the feed roller bearing 42 of the apparatus 18, while the retard side 58 of the symmetrical wedge-like member 46 of the apparatus 18 engages the retard roller bearing 44 of the apparatus 18. The feed side 56 of the symmetrical wedge-like member 46 of the apparatus 18 and the retard side 58 of the symmetrical wedge-like member 46 of the apparatus 18 are of equal length, reciprocally skewed, and extend from the bottom 52 of the symmetrical wedge-like member 46 of the apparatus 18 to the top 54 of the symmetrical wedge-like member 46 of the apparatus 18 so that no corners 60 of the symmetrical wedge-like member 46 of the apparatus 18 are 90°.

The symmetrical wedge-like member 46 of the apparatus 18 exerts reaction forces 48 against the feed roller bearing 42 of the apparatus 18 and the retard roller bearing 44 of the apparatus 18 in response to forces 50 exerted thereon by the feed roller bearing 42 of the apparatus 18 and the retard roller bearing 44 of the apparatus 18, with the reaction forces 48 acting on identical elevations 51 on the feed side 56 of the symmetrical wedge-like member 46 of the apparatus 18 and the retard side 58 of the symmetrical wedge-like member 46 of the apparatus 18 due to the symmetry of the symmetrical wedge-like member 46 of the apparatus 18, and as shown in FIG. 3, the reaction forces 48 cause the feed roll 14 and the retard roll 16 to deflect downwardly, thereby changing the nip in the center of the feed roll 14 and the retard roll 16 so as to form a non-uniform nip.

Adjustment of the pneumatic cylinder 36 of the apparatus 18 causes movement of the lever bearings 28 of the apparatus 18 to move the feed roll 14 and the retard roll 16.

SUMMARY OF THE INVENTION

Thus, an object of an embodiment of the present invention is to provide apparatus for correcting deflection in small diameter rolls of an open width stabilizer so as to create a straight line nip with uniform pressure across the nip, which avoids disadvantages of the prior art.

Briefly stated, another object of an embodiment of the present invention is to provide improved apparatus for correcting deflection in a small-diameter feed roll and a small-diameter retard roll of an open width stabilizer so as to create a straight line nip with uniform pressure across the nip. The improved device is of the type having a feed roll, a retard roll, and an apparatus for adjusting deflection of the feed roll and the retard roll to thereby maintain a desired size to a passageway between the feed roll and the retard roll to optimize compaction of a fabric web material. The apparatus includes a feed roller bearing connected to the feed roll, a retard roller bearing connected to the retard roll, and a wedge-like member disposed between, and in moving relationship to, the feed roller bearing and the retard roller bearing. The wedge-like member is asymmetrical, has a feed side that engages the feed roller bearing, a retard side that engages the retard roller bearing, and exerts reaction forces against the feed roller bearing and the retard roller bearing in response to forces exerted thereon by the feed roller bearing and the retard roller bearing. The improvement includes the reaction forces acting on different elevations on the feed side of the wedge-like member and the retard side of the wedge-like member due to the asymmetry of the wedge-like member, with the reaction forces causing the feed roll and the retard roll to not deflect downwardly, thereby not changing the nip in the center of the feed roll and the retard roll so as to create the straight line nip with uniform pressure across the nip.

The novel features considered characteristic of an embodiment of the present invention are set forth in the appended claims. An embodiment of the present invention itself, however, both as to its construction and to its method of operation together with additional objects and advantages thereof will be best understood from the following description of a specific embodiment when read and understood in connection with the accompanying figures of the drawing.

BRIEF DESCRIPTION OF THE FIGURES OF THE DRAWING

Figures of the drawing are briefly described as follows.

LIST OF REFERENCE NUMERALS UTILIZED IN THE FIGURES OF THE DRAWING

A. Prior Art

| | |
|---|---|
| 10 | prior art shrinker for fabric web material |
| 14 | feed roll |
| 16 | retard roll |
| 18 | apparatus for adjusting deflection of feed roll **14** and retard roll **16** to thereby maintain desired size to passageway **20** between feed roll **14** and retard roll **16** to optimize compaction of fabric web material |
| 20 | passageway between feed roll **14** and retard roll **16** |
| 22 | pair of ends of feed roll **14** |
| 24 | pair of ends of retard roll **16** |
| 26 | bearings of apparatus **18** |
| 28 | lever bearings of apparatus **18** |
| 29 | pillow block bearings of bearings **26** of apparatus **18** |
| 30 | pneumatic cylinder of apparatus **18** |
| 32 | shaft of apparatus **18** |
| 34 | upper end of shaft **32** of apparatus **18** |
| 36 | lower end of shaft **32** of apparatus **18** |
| 38 | axial shaft of feed roll **14** of apparatus **18** |
| 40 | axial shaft of retard roll **16** of apparatus **18** |
| 42 | feed roller bearing of apparatus **18** |
| 44 | retard roller bearing of apparatus **18** |
| 46 | symmetrical wedge-like member of apparatus **18** |
| 48 | reaction forces of symmetrical wedge-like member **46** of apparatus **18** |
| 50 | forces exerted on symmetrical wedge-like member **46** of apparatus **18** by feed roller bearing **42** of apparatus **18** and retard roller bearing **44** of apparatus **18** |
| 51 | identical elevations on feed side **56** of symmetrical wedge-like member **46** of apparatus **18** and retard side **58** of symmetrical wedge-like member **46** of apparatus **18** |
| 52 | bottom of symmetrical wedge-like member **46** of apparatus **18** |
| 54 | top of symmetrical wedge-like member **46** of apparatus **18** |
| 56 | feed side of symmetrical wedge-like member **46** of apparatus **18** |
| 58 | retard side of symmetrical wedge-like member **46** of apparatus **18** |
| 60 | corners of symmetrical wedge-like member **46** of apparatus **18** |

B. Embodiment of Present Invention

| | |
|---|---|
| 70 | asymmetrical wedge-like member of embodiment of present invention |
| 110 | open width stabilizer |
| 114 | small diameter feed roll of open width stabilizer **110** |
| 116 | small diameter retard roll of open width stabilizer **110** |
| 148 | reaction forces |
| 150 | forces |
| 151 | different elevations on feed side **156** of asymmetrical wedge-like member **70** and retard side **158** of asymmetrical wedge-like member **70** |
| 152 | bottom of asymmetrical wedge-like member **70** |
| 154 | top of asymmetrical wedge-like member **70** |
| 156 | feed side of asymmetrical wedge-like member **70** |
| 158 | retard side of asymmetrical wedge-like member **70** |
| 160 | corners of asymmetrical wedge-like member **70** |

DETAILED DESCRIPTION OF THE PREFERRED EMBODIMENTS

A. An Embodiment of the Present Invention

Figure 1:
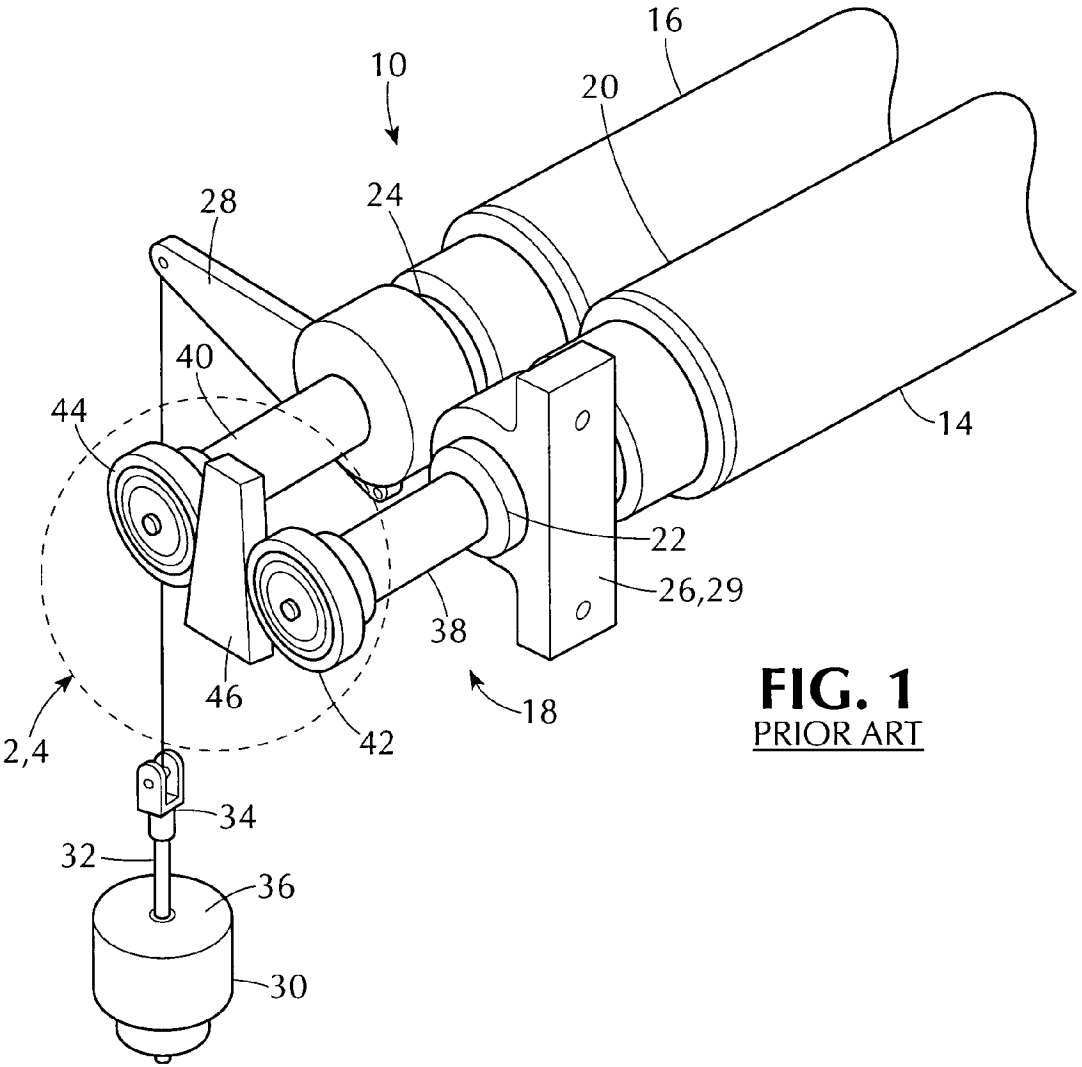
FIG. 1 PRIOR ART
FIG. 1 is a diagrammatic perspective view of a prior art two-roll fabric shrinker.
Figure 2:
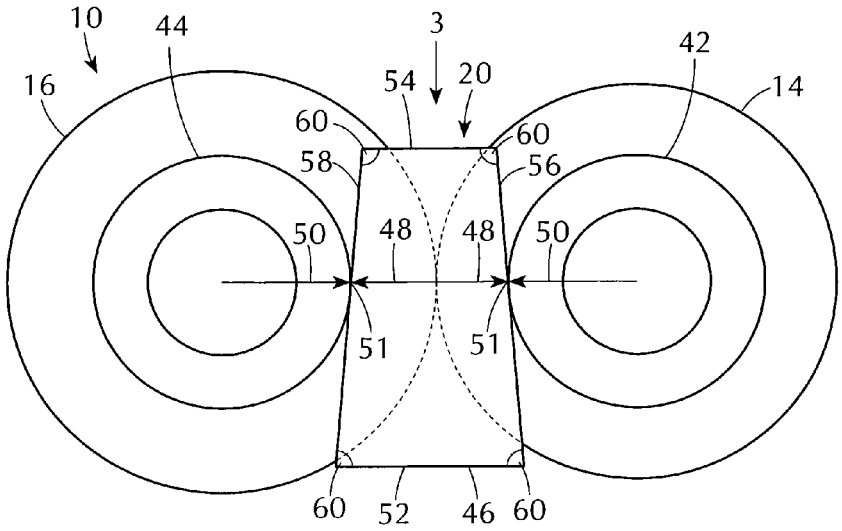
FIG. 2 PRIOR ART
FIG. 2 is an enlarged diagrammatic end view of the area generally enclosed by the dotted curve identified by ARROW 2 in FIG. 1.
Figure 3:
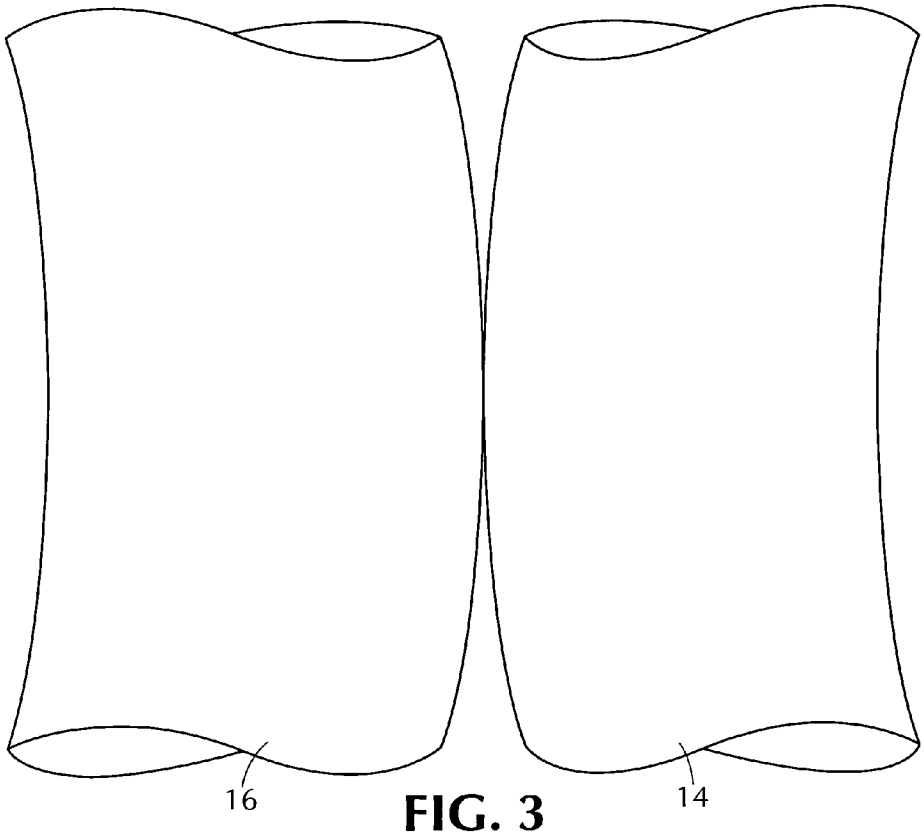
FIG. 3 PRIOR ART
FIG. 3 is a diagrammatic top plan view taken generally in the direction of ARROW 3 in FIG. 2.
Figure 4:
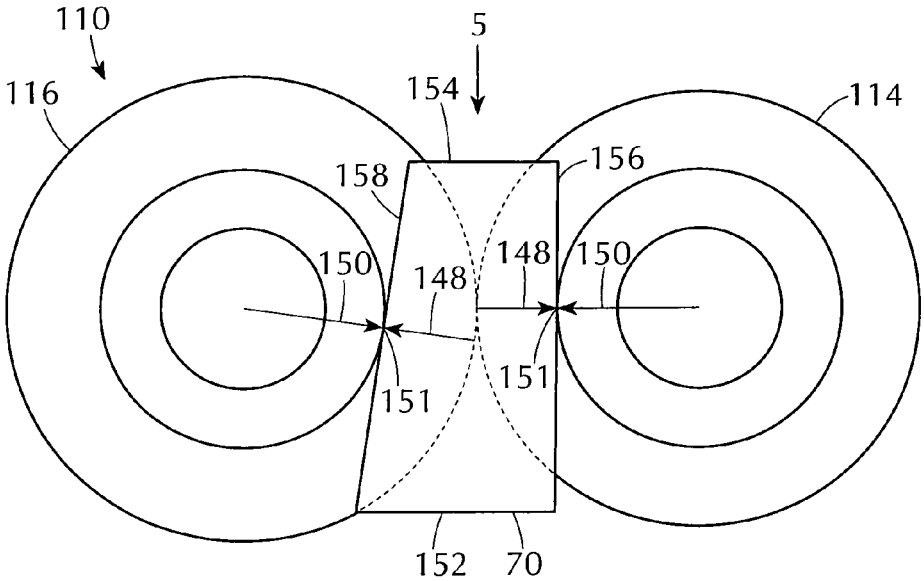
FIG. 4 is a diagrammatic end view of the area generally enclosed by the dotted curve identified by ARROW 4 in FIG. 1, and with the improved wedge replacing the prior art wedge, thereby correcting deflection in small diameter rolls of an open width stabilizer so as to create a straight line nip with uniform pressure across the nip.
Figure 5:
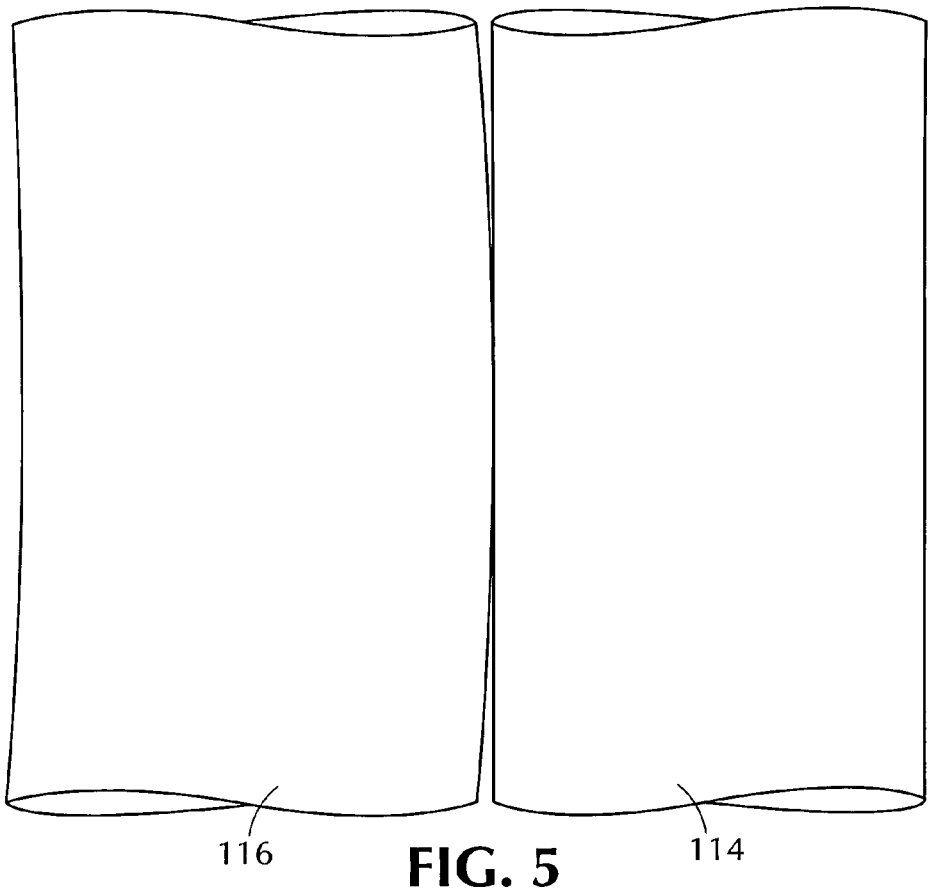
FIG. 5 is a diagrammatic top plan view taken generally in the direction of ARROW 5 in FIG. 4.

Referring now to the FIGS. 4 and 5, which are, respectively, a diagrammatic end view of the area generally enclosed by the dotted curve identified by ARROW 4 in FIG. 1, but with the improved wedge replacing the prior art wedge and thereby correcting deflection in small diameter rolls of an open width stabilizer so as to create a straight line nip with uniform pressure across the nip, and a diagrammatic top plan view taken generally in the direction of ARROW 5 in FIG. 4, the asymmetrical wedge-like member of an embodiment of the present invention is shown generally at 70 for correcting deflection in a small diameter feed roll 114 and a small diameter retard roll 116 of an open width stabilizer 110 so as to create a straight line nip with uniform pressure across the nip.

The asymmetrical wedge-like member 70 is similar to the symmetrical wedge-like member 46 of the apparatus 18, except that:

The top 154 of the asymmetrical wedge-like member 70 is not centered on the bottom 152 of the asymmetrical wedge-like member 70;

The feed side 156 of the asymmetrical wedge-like member 70 is shorter than the retard side 158 of the asymmetrical wedge-like member 70;

The feed side 156 of the wedge-like member 70 is preferably perpendicular to or substantially perpendicular to the horizontal centerline of the feed roll 114; and The reaction forces 148 in response to forces 150 exerted by the feed roll 114 and the retard roll 116 cause the feed roll 114 and the retard roll 116 to not deflect downwardly, thereby not changing the nip in the center of the feed roll 114 and the retard roll 116 so as to create the straight line nip with the uniform pressure across the nip.

B. Another Embodiment of the Present Invention

Alternatively, other ways may be employed to create a straight nip with uniform pressure across the nip by using a linear actuator to open and close the retard roll and also to apply pressure against the ends of the feed roll and the retard roll.

C. Impression

It will be understood that each of the elements described above or two or more together may also find a useful application in other types of constructions differing from the types described above.

While an embodiment of the present invention has been illustrated and described as embodied in an apparatus for correcting deflection in small diameter rolls of an open width stabilizer so as to create a straight line nip with uniform pressure across the nip, however, it is not limited to the details shown, since it will be understood that various omissions, modifications, substitutions, and changes in the forms and details of an embodiment of the present invention illustrated and its operation can be made by those skilled in the art without departing in any way from the spirit of an embodiment of the present invention.

Without further analysis the foregoing will so fully reveal the gist of an embodiment of the present invention that others can by applying current knowledge readily adapt it for various applications without omitting features that from the standpoint of prior art fairly constitute characteristics of the generic or specific aspects of an embodiment of the present invention.

The invention claimed is:

1. An improved apparatus for correcting deflection in a small diameter feed roll and a small diameter retard roll of an open width stabilizer so as to create a straight line nip with uniform pressure across the nip, wherein the improved apparatus is of a type having a feed roll, a retard roll, and an adjusting apparatus for adjusting deflection of the feed roll and the retard roll to thereby maintain a desired size to a passageway between the feed roll and the retard roll to optimize compaction of a fabric web material, wherein the adjusting apparatus includes a feed roller bearing connected to the feed roll, a retard roller bearing connected to the retard roll, and a wedge-like member disposed between, and in moving relationship to, the feed roller bearing and the retard roller bearing, wherein the wedge-like member has a feed side that engages the feed roller bearing, a retard side that engages the retard roller bearing, and exerts reaction forces against the feed roller bearing and the retard roller bearing in response to forces exerted thereon by the feed roller bearing and the retard roller bearing, and wherein said improvement comprises the reaction forces acting on different elevations on the feed side of the wedge-like member and the retard side of the wedge-like member due to the feed side of the wedge-like member being substantially perpendicular to the horizontal centerline of said feed roll, with the reaction forces causing the feed roll and the retard roll to not deflect downwardly, thereby not changing the nip in the center of the feed roll and the retard roll so as to create the straight line nip with the uniform pressure across the nip.

2. The improvement of claim 1, wherein said improvement comprises said wedge-like member having:

a) a bottom; and b) a top;

wherein said top of said wedge-like member is not centered on said bottom of said wedge-like member.

3. The improvement of claim 1, wherein said improvement comprises said feed side of said wedge-like member being shorter than said retard side of said wedge-like member so as to form an asymmetrical wedge-like member.

4. The improvement of claim 1, wherein said improvement comprises said feed side of said wedge-like member being substantially perpendicular to the horizontal centerline of said feed roll.

5. The improvement of claim 1, wherein said improvement comprises said reaction forces in response to forces exerted by said feed roll and said retard roll causing said feed roll and said retard roll to not deflect downwardly, thereby not changing said nip in said center of said feed roll and said retard roll so as to create said straight line nip with said uniform pressure across said nip.

* * * * *